US005924130A

United States Patent [19]

Fragomeli

[11] Patent Number: 5,924,130

[45] Date of Patent: Jul. 20, 1999

[54] PROTECTIVE SLEEVE

[76] Inventor: Anastasia Fragomeli, 550 Lower North East Road, Campbelltown South Australia 5174, Australia

[21] Appl. No.: 08/737,535

[22] PCT Filed: May 11, 1995

[86] PCT No.: PCT/AU95/00277

§ 371 Date: Nov. 12, 1996

§ 102(e) Date: Nov. 12, 1996

[87] PCT Pub. No.: WO95/31118

PCT Pub. Date: Nov. 23, 1995

[30] Foreign Application Priority Data

May 12, 1996 [AU] Australia ..... PM 5576

[51] Int. Cl.[6] ..... A41D 1/00

[52] U.S. Cl. ..... 2/16; 2/59

[58] Field of Search ..... 2/16, 46, 49.1, 2/49.4, 50, 51, 59, 60, 125, 126, 159, 161.6, 161.7, 162, 164, 167, 168, 170

[56] References Cited

U.S. PATENT DOCUMENTS

| | | | |
|---|---|---|---|
| 2,058,040 | 10/1936 | Severn | 2/59 |
| 2,150,069 | 3/1939 | Koleno | 2/59 |
| 2,326,422 | 8/1943 | Weisberger . | |
| 2,334,498 | 11/1943 | Merkent | 2/126 |
| 2,512,920 | 6/1950 | Collins | 2/50 |
| 3,608,092 | 9/1971 | Taranto | 2/49.1 |
| 3,657,741 | 4/1972 | Blanco | 2/59 |
| 4,285,067 | 8/1981 | David | 2/46 |
| 4,458,364 | 7/1984 | Fenninger et al. | 2/50 |
| 4,843,645 | 7/1989 | White . | |
| 5,322,918 | 6/1994 | Kirby | 2/50 |
| 5,335,372 | 8/1994 | Weidner et al. . | |
| 5,542,121 | 8/1996 | Lahaussois et al. | 2/59 |

FOREIGN PATENT DOCUMENTS

| | | | |
|---|---|---|---|
| 277696 | 1/1928 | United Kingdom | 2/59 |
| 287546 | 5/1928 | United Kingdom | 2/59 |
| 2237975 | 5/1991 | United Kingdom . | |

*Primary Examiner*—Gloria M. Hale
*Attorney, Agent, or Firm*—Emerson & Associates; Roger D. Emerson; Timothy D. Bennett

[57] ABSTRACT

A protective sleeve including a fastener to fasten the sleeve around an arm of a wearer so as to be retained in position. The sleeve extends to the upper arm of the user. The protective sleeve includes an inner layer of water proof material extending the length of the sleeve and an outer most layer of absorptive material covering the inner layer circumferentially. The outer layer acts to retard liquid running along the length of the sleeve.

16 Claims, 2 Drawing Sheets

PROTECTIVE SLEEVE

This application is a National Phase of a PCT application PCT/AU95/00277, filed May 11, 1995.

FIELD OF THE INVENTION

The present invention relates to a sleeve for protecting the arms of a wearer from contact with liquids that otherwise might have an adverse effect on the skin of the user.

There are many circumstances where it is desired to protect the arms from contact with fluids that have an adverse effect on the skin of the user. This is particularly the case where caustic or acidic solutions are used for cleaning. The difficulty generally does not arise where the hands are immersed into a bucket of cleaning liquid because water impervious gloves are usually worn, but rather where the hands are lifted above the horizontal and cleaning liquid runs down the gloves onto the arms.

It is known to provide for protection of the forearm, or even up to the shoulders in the form of a plastics sleeve but this protection is only intended to maintain cleanliness of the forearm. The use of a plastic sleeve however does not alleviate the problem of keeping liquid of the arms and such plastics sleeves only protect against a minimal amount of spill before cleaning liquid streams down the arms beyond the end of the plastics sleeves.

It has been suggested before to construct gloves that include a layer for retaining water on the outside of a water impermeable layer. The water retaining layer however is simply on the glove to act in much the same way as a sponge, so as to apply cleaning preparation without having separately to use a sponge. Examples of such suggestions can be found in British patent application GB2113977 and British application GB 899016. Scourer pads have also been suggested for use with such gloves, to add to their usefulness such as in British patent application GB2033731 or as in British Patent 21343171 to Koumbas. These gloves however are primarily concerned with applying cleaning fluid to the surface that requires cleaning, and have no regard for the more awkward problem of liquid running down a raised arm. In fact the use of such gloves exacerbates the problem because larger amounts of liquid are temporarily retained and progressively released down the arm.

It has also been suggested in Australian Patent specification 490155 (73535/74) to provide a surgical gown which includes a central operative field of the front panel of the gown having a fluid impervious material having an absorbent outer surface to absorb fluids that might come in contact with the central operative field. Use of an absorptive layer on the gown is said to minimise the amount of liquid run-off.

There has however, to the inventor's knowledge, not been an article to provide protection to the arms of the wearer, that is convenient to use with gloves, that provides for secure and close fitting over the arm, is easy to carry, and to put on and discard, or to fit all user sizes.

Accordingly it is an object of this invention to provide a protective sleeve that protects arms of a user against unwanted contact with a fluid that obviates or minimises any one of the aforementioned problems in a simple yet effective way, or at least provides the public with a useful choice.

SUMMARY OF THE INVENTION

In a broad form and not necessarily the broadest or only form the invention could be said to reside in a protective sleeve including fastening means to fasten around an arm of a wearer so as to be retained in position, said protective sleeve including an inner layer of water proof material extending the length of the sleeve, an outermost layer of absorptive material covering said inner layer circumferentially so as to retard liquid run off along the sleeve, said sleeve extending to the upper arm of the user.

The fastening means may be in the form of an elasticised section that fits around the wrist of the wearer. Conveniently the sleeve is fitted over the arm and secured, and waterproof gloves are fitted over the outer end of the sleeve so that there is considerable overlap consequently a sealing fit of the sleeve over the arm is not required.

Alternatively the fastening means might include a loop that hooks over the thumb of a user, thereby preventing travel of the sleeve away from the hand.

In a preferable form the absorptive layer is substantially coextensive with the water proof layer. Most preferably the sleeve is formed from a laminate of waterproof and absorptive material, the laminate being produced before the sleeve is formed.

It is to be understood, however, that the absorptive material may simply be adhered to a waterproof sleeve with a suitable plastics adhesive. The absorptive material may be of any material that is absorptive, and generally it is intended that the sleeve is re-useable, the absorptive material is accordingly preferably somewhat resistant to water and/or he liquid being used and may be of a woven fabric.

It may be desired to have rather thicker absorptive material however not coextensive with the sleeve but rather formed in bands formed around the sleeve. The absorptive material of these bands may be in the form of a sponge-like material.

The waterproof material is preferably a plastics or rubber material, such as are already used for protective sleeves, or gloves. In one form the plastics of the sleeves is of a material that whilst water resistant is still able to allow passage of some air so that the sleeve is breathable.

In an alternative form a chemically resistant layer is also provided which is resistant to chemicals for which the sleeve is intended for use with. The chemically resistant layer may be separate from the waterproof layer or it may be integral with it.

It may be convenient to produce the protective sleeve integrally with a glove. It is envisaged that the glove portion would not include an absorptive layer, because the absorptive layer would lead to an increase in liquid spilling down the sleeve.

Whilst certain indication have been given relating to the scope of the invention it is to be understood that the invention may reside in two or more of these indications combined.

BRIEF DESCRIPTION OF THE ILLUSTRATED EMBODIMENTS

To assist with the understanding of the invention several embodiments are illustrated. It is to be understood from the foregoing that the illustrated embodiments of the invention are merely illustrative and in no way restrict the scope of the invention.

In the illustrations:

FIG. 1 is an illustration of a first embodiment of the protective sleeve fitted to the arm of a wearer with the hand proximal portion of the sleeve fitted under a pair of water proof gloves, FIG. 2 is a cross sectional detail of the first embodiment showing the laminate between the waterproof material and the absorptive layer and formation of an elasticised end, FIG. 3 is an illustration of a second embodiment of the protective sleeve fitted to an arm of a wearer the hand distal portion of the sleeve extending just past the elbow of the wearer, FIG. 4 is detail of both ends of the second embodiment showing constructional detail of the ends of the sleeve and the method of keeping the waterproof and the absorbent layer together, FIG. 5 is an illustration of a third embodiment having an integral glove to cover the hand the glove portion not having any absorptive covering, and the absorptive layer being kept in close proximity with the water proof layer by use of a plurality of spaced apart contacts.

FIG. 6 is a cross sectional view showing detail of the means of keeping the waterproof and absorbent layers together, FIG. 7 is a view of a fourth embodiment of the invention wherein bands of absorptive material are spaced along the length of the sleeve, and FIG. 8 is a cross sectional view showing details of the bands of absorptive material connected to the waterproof layer.

Similar reference characters indicate corresponding parts throughout the several views of the drawings.

Dimensions of certain of the parts as shown in the drawings may have been modified and/or exaggerated for the purposes of clarity of illustration.

DETAILED DESCRIPTION OF THE ILLUSTRATED EMBODIMENTS

The protective sleeve of this invention comprises an inner layer (1) of waterproof material extending along the length of the sleeve, and an outermost layer (2) of absorptive material that covers the inner layer circumferentially, so that liquid running along the length of the sleeve absorbs into the absorptive layer and the running off is at least retarded.

Figure 1:
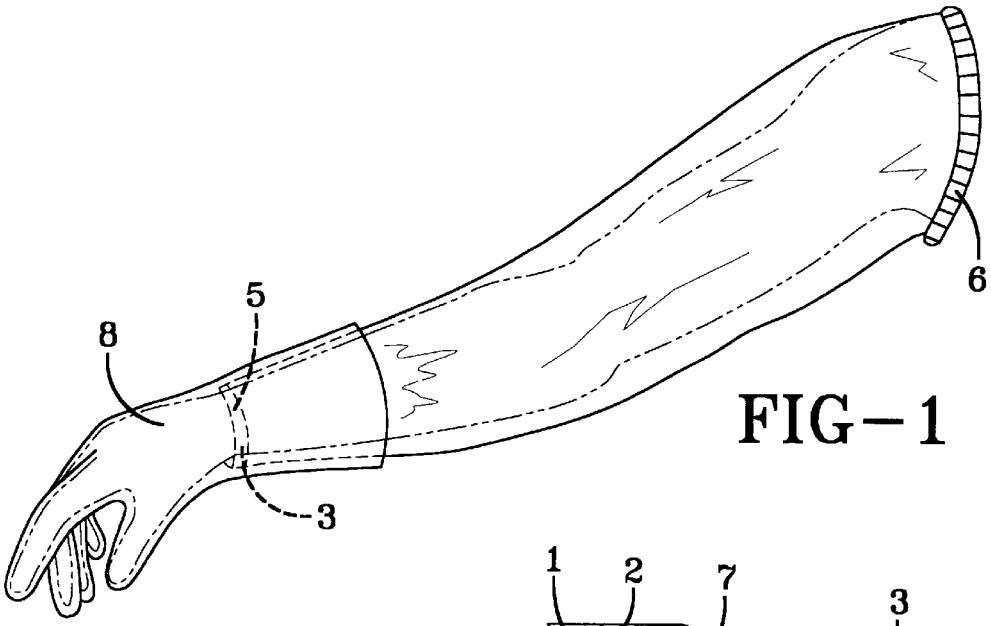
Figure 2:
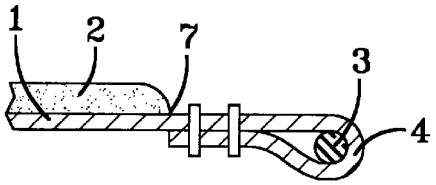

The first embodiment illustrated in FIG. 1 and FIG. 2 comprises two layers, a water proof plastics layer 1 on an inside of the sleeve that acts as a support for an absorptive layer 2. An outer end of the plastics layer is folded over and an elastic member 3 is inserted in the channel 4 so formed. The channel is sewn closed. The elasticised outer, hand proximal end (5) of the sleeve acts to hold the sleeve in position on the wrist of the user.

The inner, or hand distal (6) end of the sleeve extends to the shoulder of the user, and is also elasticised in a manner similar to that on the hand proximal end to be retained on the shoulder of the user. It may be desired to provide for a further fastening means for the inner end, for example it may be desired to have a band extending from the inner end around the shoulder of the user, so as to maintain the sleeve as high up on the arm as is practicable. The length of the sleeve is illustrated as being up to the shoulder.

The absorptive material shown in this embodiment is substantially coextensive with the plastics material, except at the outer end of the sleeve there is no absorptive material covering the elasticised portion, so that liquid is not retained on the stitching of the sleeve. It is to be understood that the invention also encompasses forms where the absorptive material is not co-extensive with the water-proof material.

The absorptive material in this embodiment is a flannel material adhered to a plastics sleeve using an adhesive layer (7). A laminate so formed is preferable to having the flannel separate from the plastics material, because where there is no laminate type structure there are portions of the sleeve where the flannel material is not in contact with the plastics material and the liquid can progress along the sleeve much more rapidly.

In use the sleeve is fitted onto the arm of the user and the hand distal end (6) is secured to the shoulder, which term is intended to include the upper parts of the arm close to the shoulder. The hand proximal portion of the sleeve is securely fitted to the wrist. A water proof glove 8 is then put on and the sleeve and glove is ready for use.

When the arm is raised the sleeve is particularly effective, in that water or other cleaning liquid will run off the glove onto the sleeve and become absorbed by the flannel of the absorptive layer. It will be understood the capacity of the sleeve to absorb liquid is not infinite and that where great amounts of liquid are to be used then the moisture will exceed the capacity of the outer layer to absorb.

Whilst a plastics layer is used on the flannel, it may be preferred to coat the flannel or other absorptive layer with a water impermeable coating thereby forming an impermeable layer.

Figure 3:
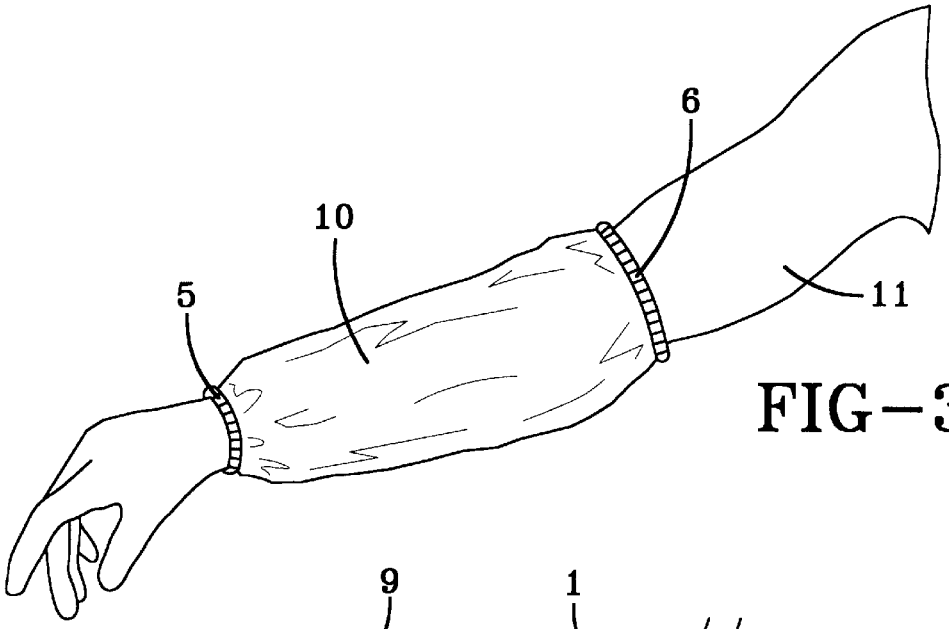
Figure 4:
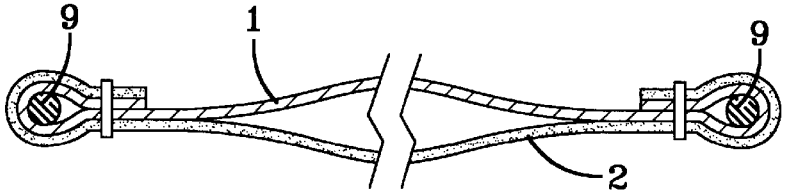

A second embodiment of the invention is illustrated in FIGS. 3 and 4. This comprises a plastics layer (1) which is quite separate from the water absorptive layer (2). This sleeve is intended more as a disposable sleeve so that the outer layer is simply a layer of absorptive paper. Instead of having the two layers adhered together the layers are joined only at the two ends (5, 6) of the sleeve. An elasticised band (9) as well as aligned ends of the plastics and paper layer are over sewn together, as is best seen in FIG. 4.

Whilst it is a slight disadvantage that the two layers are not contacted together, there is still sufficient contact between the two layers along the length of the sleeve such that moisture does not simply soak through the absorptive layer close to the glove and run along the plastics layer with minimal moisture absorption. In use, the two layers do not represent two well formed cylinders, but they have a considerable number of folds and curves as a result of the complex shape of a dynamic arm and consequently a great number of contacts are made between the two layers.

The length of the sleeve is somewhat shorter than that of the first embodiment, and extends past the elbow of users. The hand distal end of this embodiment is intended to end approximately half way between the elbow and the shoulder. This is found to be a considerably more comfortable arrangement to wear, leading to more secure fitting around the upper part of the arm. Generally when the arm is lifted during cleaning, generally the elbow is still bent, so that generally the greatest amount of water flow is on the forearm of the user, only very rarely does liquid contact the upper arm. Consequently it is of considerably greater importance to protect the lower arm (10) of the user rather than upper arm (11).

Figure 5:
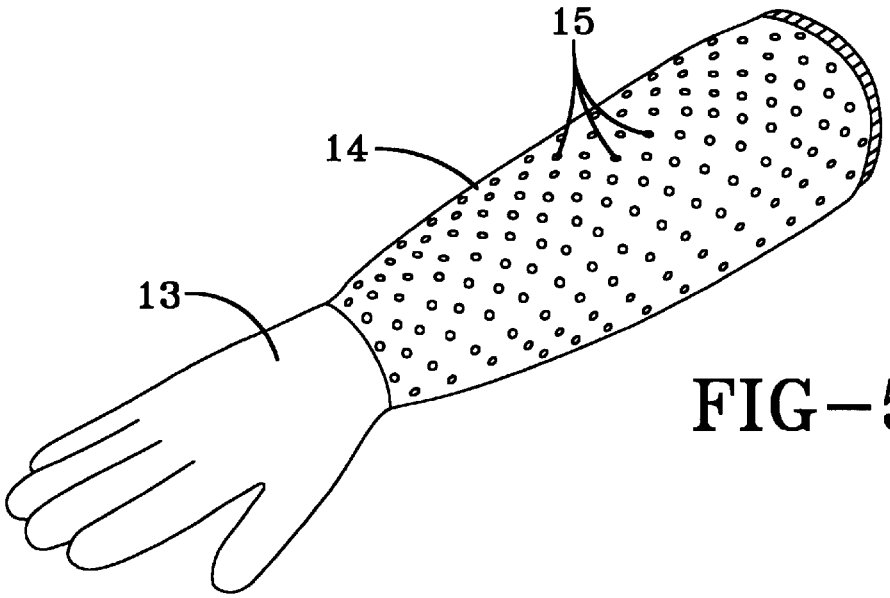
Figure 6:
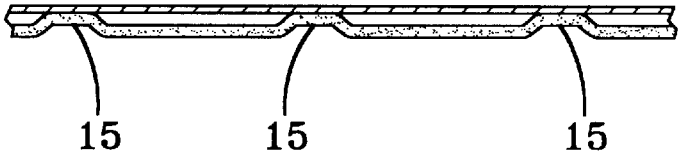

A third embodiment of the invention is illustrated in FIGS. 5 and 6. This embodiment comprises a combined sleeve and glove (13). The glove comprises a suitable water resistant material that is sufficiently robust to withstand the use to which it is to be put. No absorptive layer covers the glove. A sleeve portion (14) of the glove comprises a water resistant layer that is integrally formed with the glove portion. The absorbent layer is formed onto the sleeve portion by a heat welding process giving a stippled look. The heat welds (15) being patterned over the sleeve. The hand distal portion of the sleeve is gathered as for the other illustrated embodiments and has an elasticised band attached.

This embodiment has the advantage that separate gloves need not be used, and that only one item needs to be donned for each arm and hand. The glove portion is not covered with an absorptive layer because that would lead to a greater supply of residual liquid to run off down the sleeve. One difficulty however is that different sizes may be needed depending on the hand size of the user. Whilst the illustrated third embodiment shows a sleeve portion that extend to past the elbow of a user and not to the shoulder, it may be desired to have a shoulder length sleeve portion in connection with a glove.

It is to be understood that the stippled heat welded double layer is advantageous in that the two layers are held in close proximity whilst not requiring the expense of forming an adhesive layer therebetween or a laminate. It is also to be understood that this material may be used in embodiment of the sleeve having no glove and that other double layers may also be used. Furthermore the sleeve portion need not be integrally formed with the glove and may be joined provided that the join is water proofed.

Figure 7:
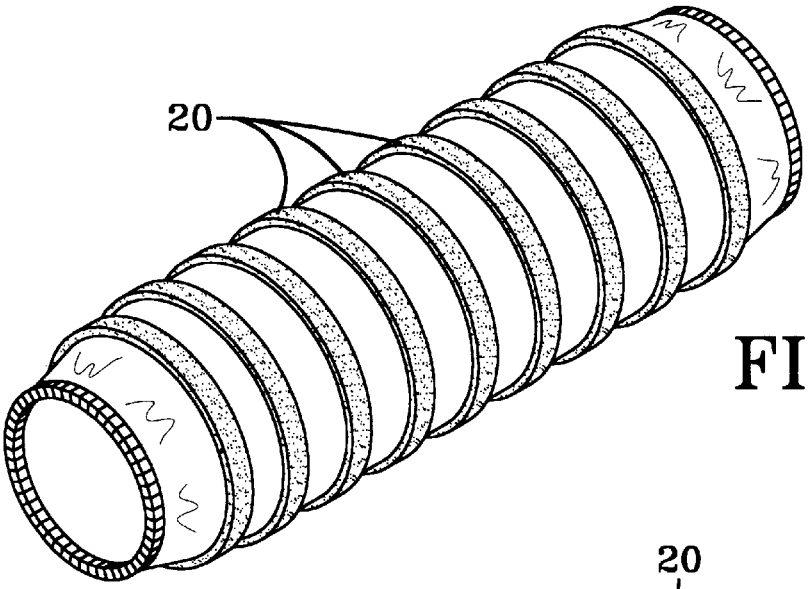
Figure 8:
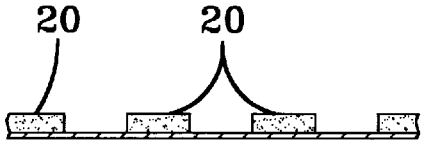

A fourth embodiment of the invention is illustrated in FIGS. 7 and 8. In this embodiment the water proof layer (1) forms the sleeve. The absorbent layer is provided in the form of bands (20) that are spaced apart longitudinally along the sleeve. The bands of absorptive material comprise a sponge material and are shown as being considerably thicker than the absorptive layers shown in the other embodiments. The bands of sponge are approximately 7 mm thick. This embodiment has the capacity for absorbing a considerable volume of water. Each of the bands acts as a barrier to flow of liquid where a greater quantity of liquid is anticipated. Furthermore the bands act to spread the flow of water laterally so that unlike where a layer of absorptive paper is used streams of water will be rapidly spread and more easily absorbed.

This sleeve is shown as the same length as that of the third embodiment and as with the third embodiment this may also take the form of a shoulder length sleeve.

Additionally where a considerable flow of liquid is anticipated it may be desirable to provide a continuous absorptive layer such as described in anyone of the first three illustrated embodiments, together with a banded layer such as described in the fourth embodiment superimposed on top of the continuous layer.

Other arrangements of discontinuous absorptive layer may also be provided.

Whilst only a two layered arrangement has been shown, it may be desirable to have more than two layers, provided that the outer layer is absorptive, and that there is a layer internal of the absorptive layer that is impermeable to liquid. It may be desirable for comfort to the wearer to provide a three layered sleeve, where an internal absorptive layer is also provided to take up moisture internally of the sleeve, for example from perspiration.

I claim:

1. A protective sleeve for use in protecting a raised arm of a wearer from liquid run off, the protective sleeve comprising:

fastening means for fastening around the associated raised arm so as to be retained in position;

an inner layer of water proof material extending the length of the protective sleeve; and, an outermost layer of absorptive material covering said inner layer circumferentially so as to retard the liquid run off along the protective sleeve, said protective sleeve extending to the upper arm of the wearer.

2. A protective sleeve as in claim 1 wherein fastening means comprises an elasticised section that fits around the upper arm of the wearer.

3. A protective sleeve as in claim 2 wherein a hand proximal portion of the sleeve is open.

4. A protective sleeve as in claim 1 wherein fastening means comprises an elasticised section that fits around the shoulder of the wearer.

5. A protective sleeve as in claim 4 wherein a hand proximal portion of the sleeve is open.

6. A protective sleeve as in claim 1 wherein a hand proximal portion of the sleeve is open.

7. A protective sleeve as in claim 6 wherein the fastening means includes an elasticised section that fits around the wrist of the wearer.

8. A protective sleeve as in claim 6 wherein the absorptive layer is adhered to the water proof layer only at a hand distal end and the hand proximal end.

9. A protective sleeve as in claim 1 wherein the absorptive layer is substantially coextensive with the water proof layer.

10. A protective sleeve as in claim 1 wherein said inner layer and said outer layer are laminated together.

11. A protective sleeve as in claim 1 where the absorptive outer layer is thick and is not co-extensive with the sleeve and is formed in bands around the sleeve.

12. A protective sleeve as in claim 11 where the absorptive material of the bands is in the form of a sponge material.

13. A protective sleeve as in claim 1 wherein the absorptive layer is adhered to the waterproof layer at a number of spaced apart locations throughout the sleeve but not all throughout.

14. A protective sleeve as in claim 1 wherein the absorptive layer is an absorptive paper.

15. A protective sleeve and glove combination comprising:

fastening means for fastening around an arm of a wearer so as to be retained in position;

an inner layer of water proof material extending the length of the sleeve; and, an outermost layer of absorptive material covering said inner layer circumferentially so as to retard liquid run off along the sleeve, the sleeve extending to the upper arm of the wearer, the glove being integral with the sleeve.

16. A protective sleeve and glove combination as in claim 15 wherein the glove portion does not include an absorptive layer.

* * * * *